United States Patent [19]

Hanérus et al.

[11] Patent Number: 4,964,444

[45] Date of Patent: Oct. 23, 1990

[54] APPARATUS FOR CLEANING A FILLING PIPE

[75] Inventors: Göran Hanérus, Malmö ; Tommy Ljungström, Höör, both of Sweden

[73] Assignee: Roby Teknik Aktiebolag, Lund, Sweden

[21] Appl. No.: 326,176

[22] Filed: Mar. 20, 1989

[30] Foreign Application Priority Data

Mar. 21, 1988 [SE] Sweden ..... 8801029

[51] Int. Cl.[5] ..... B67C 3/22

[52] U.S. Cl. ..... 141/90; 141/91; 141/258; 134/170; 134/166 R; 53/425

[58] Field of Search ..... 141/89, 90, 91, 92, 141/258, 237, 238, 242, 244; 53/425, 432, 86, 426; 134/166 R, 166 C, 169 R, 170

[56] References Cited

U.S. PATENT DOCUMENTS

| | | | |
|---|---|---|---|
| 4,213,795 | 7/1980 | Ernstsson et al. | 141/90 X |
| 4,527,377 | 7/1985 | Hayashi et al. | 141/90 X |
| 4,572,252 | 2/1986 | Ponzi et al. | 141/90 |
| 4,579,156 | 4/1986 | Graffin | 141/89 |
| 4,601,885 | 7/1986 | McClure | 141/90 X |

FOREIGN PATENT DOCUMENTS

| | | | |
|---|---|---|---|
| 2750233 | 5/1979 | Fed. Rep. of Germany | 141/90 |
| 1183149 | 3/1970 | United Kingdom . | |
| 1375472 | 11/1974 | United Kingdom . | |

*Primary Examiner*—Ernest G. Cusick

*Attorney, Agent, or Firm*—Burns, Doane, Swecker & Mathis

[57] ABSTRACT

To provide a suitable filling atmosphere around a produce filling pipe on a packing machine and to make possible a rational, accurate cleaning of the filling pipe of the machine without having to dismantle and disassemble the filling pipe at a normal stoppage of the machine, the filling pipe is surrounded by a permanent tubular casing whose lower end is adapted so that it can be closed for cleaning with the aid of a detachable lid to form a container enclosing the filling pipe. The filling pipe, via a connecting means at the upper end of the casing, can be joined to an outer flow system to allow circulation of a cleansing agent.

7 Claims, 2 Drawing Sheets

APPARATUS FOR CLEANING A FILLING PIPE

BACKGROUND OF THE INVENTION

The present invention relates to an arrangement on a packing machine to provide a product filling tube with a sterile filling atmosphere and to make possible a cleaning of the product filling pipe. The filling pipe belongs to a packing machine that is used primarily for the filling of packing containers with liquid foodstuffs.

In the packaging trade it is customary to pack contents of liquid foodstuffs, e.g. milk, in finished consumer packages of non-returnable character. Packaging of the foodstuffs most often is done with the help of modern, rationally operating packing machines which, at a high rate of production, manufacture filled, sealed packages under hygienically acceptable production conditions. The packing machines of the type referred to here operate to form, fill and seal packages from prefabricated, sheetlike blanks of a suitable packing material, usually plastic-coated paper which has been prepared with suitable decoration and with a pattern of so-called crease lines facilitating the fold formation. From flattened tubular package blanks, the machine produces packages wherein the packing blanks first are raised to form open, tubular packing boxes of generally rectangular cross-section with the aid of a so-called box-raising means. The box-raising means feeds the blanks one at a time from a magazine and deposits the raised blanks on a movable conveyor belt which conveys and transfers them to a first forming station of the machine where the one end or base of the boxes is closed. The base-forming station of the machine comprises an intermittently rotating mandrel wheel with radial mandrels. The radial mandrels are adapted to receive the boxes in the correct feed position on the conveyor belt for the stepwise transport of the same through a number of base-forming, shaping and sealing stations located around the mandrel wheel. The packing boxes provided with a base subsequently are removed from the mandrels and placed on a conveyor belt which is advanced synchronously with the indexing rotation of the mandrel wheel and which conveys the boxes provided with a base in upright position to the filling station of the machine where the boxes are filled with suitable portions of contents. The filling stations, which often are substantially surrounded by a covering machine casing, usually comprise a vertical product filling pipe opening into the filling station. Via product supply pipe with metering pump connected thereto, the filling pipe is joined to a tank containing the contents. The metering pump is adapted so as to pump from the product tank weighed portions of contents through the product filling pipe down into the packing boxes advanced centrally below the product filling pipe. From the filling station the filled packing boxes are conveyed to the final forming station of the machine where the boxes, by means of forming and sealing operations, are given a liquid-tight top closure. Thereafter, the boxes, the form of finished consumer packages, are discharged from the machine for further distribution.

As mentioned earlier, it is important that the packaging, especially in the case of contents of the foodstuffs type, takes place under guaranteed hygienically acceptable conditions. Among other things, this means that machine parts which come into direct contact with the contents should be protected as fully as possible, so as not to come into contact with the non-sterile environmental atmosphere of the machine. A certain protection against the environment is achieved with the help of the machine casing surrounding the filling station. Within the casing, a pressurized atmosphere of hot sterile air is maintained and non-sterile environmental air is effectively prevented from penetrating. The use of hot sterile air in the known packing machine has been found to entail certain inconveniences which, whilst possibly not representing any direct serious threat to machine hygiene, does in certain cases, involve the obvious danger of the hot air condensing on the outside of the filling pipe and dropping down into the packing boxes. The use of hot air of course also demands energy and thus increases cost. A hygienically unobjectionable packaging of foodstuffs moreover demands that at least those parts of the machine with which the foodstuffs come into contact are subjected regularly, usually in conjunction with normal operational stoppages at night, to an accurate cleaning or washing process. Such cleaning and washing is necessary so as to remove and prevent the risk of foodstuff deposits promoting bacteria growth which, especially when using hot sterile air, seriously jeopardize the prerequisites for the machine complying with the threshold standards of hygiene. Such a machine component requiring special care and attention is of course the product filling pipe of the machine. It has been necessary up to now first to dismantle and remove this part from the machine in order successfully to clean it on its outside as well as its inside, and afterwards to reinstall it in the machine. Apart from this cleaning operation being time-consuming and requiring manual functions for the disassembling and reassembling of the filling pipe, it is unsatisfactory also in that the machine operator risks coming into contact with, and polluting, the outside of the product filling pipe during reinstallation.

OBJECTS AND SUMMARY OF THE INVENTION

It is an object of the present invention thus to avoid the disadvantages and deficiencies encountered up to now in connection with the known packing machines and provide a simple arrangement from which it is possible to create a sterile filling environment around the product filling pipe on a packing machine of the type mentioned. It is a further object to provide an arrangement such that it is possible to perform an accurate, effective cleaning of all machine parts coming into contact with the actual contents without any of these parts having to be dismantled or removed from the machine.

This object is achieved in accordance with the present invention as described in the appended claims.

Particularly preferred embodiments of the arrangement in accordance with the invention are also described in the claims.

BRIEF DESCRIPTION OF DRAWINGS

The invention will now be described in greater detail with special reference to the attached drawings which illustrate schematically the actual filling station on a conventional packing machine on which a preferred embodiment of an arrangement in accordance with the invention can be used advantageously in order to provide a sterile filling environment around, and to make possible a cleaning of, the product filling pipe of the machine.

DETAILED DESCRIPTION

Figures 1, 3:
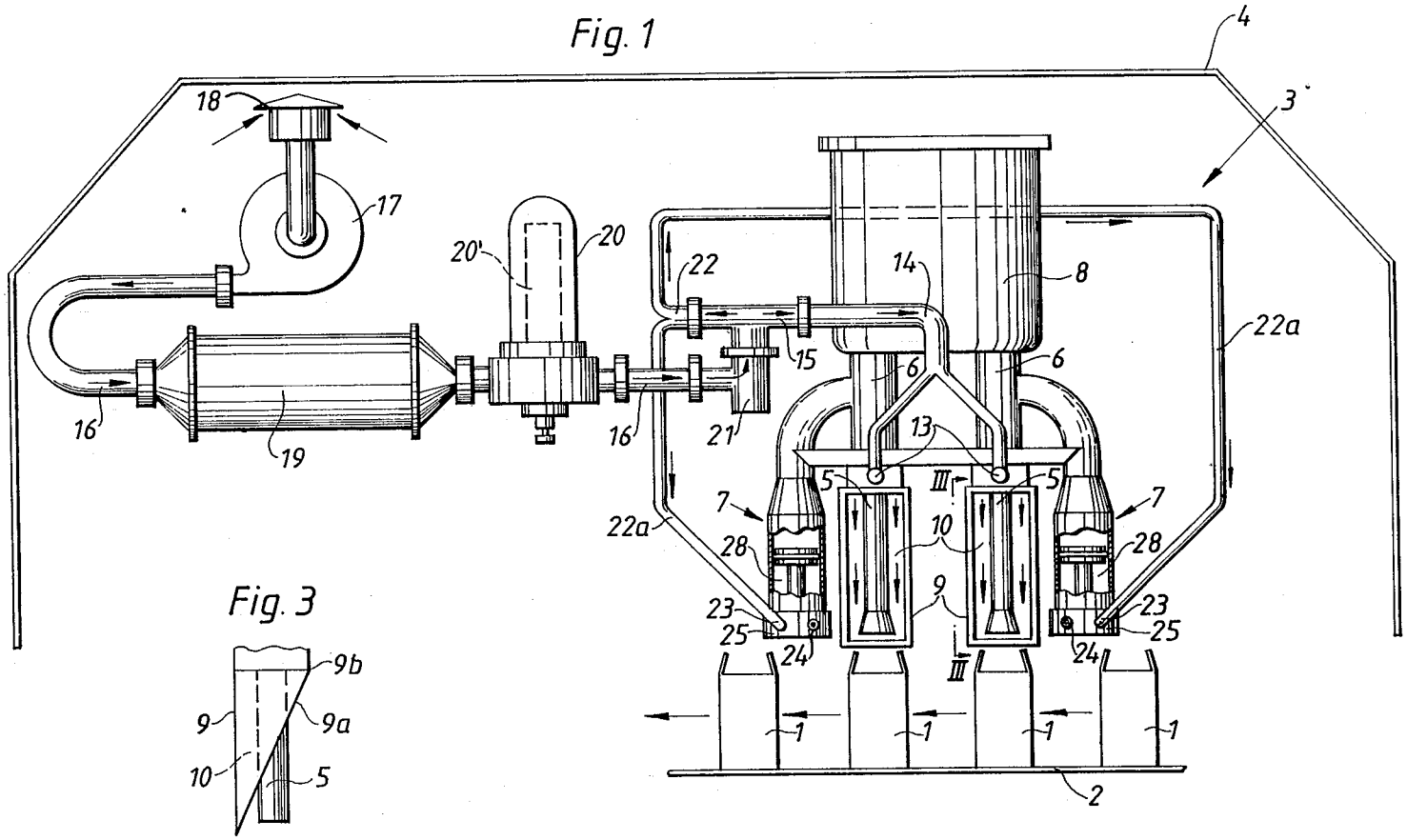
FIG. 1 shows a filling process during which the arrangement provides the sterile filling atmosphere.
FIGS. 3 and 4 show the arrangement in views along the lines III—III and IV—IV in FIG. 1 and 2 respectively.
Figures 2, 4:
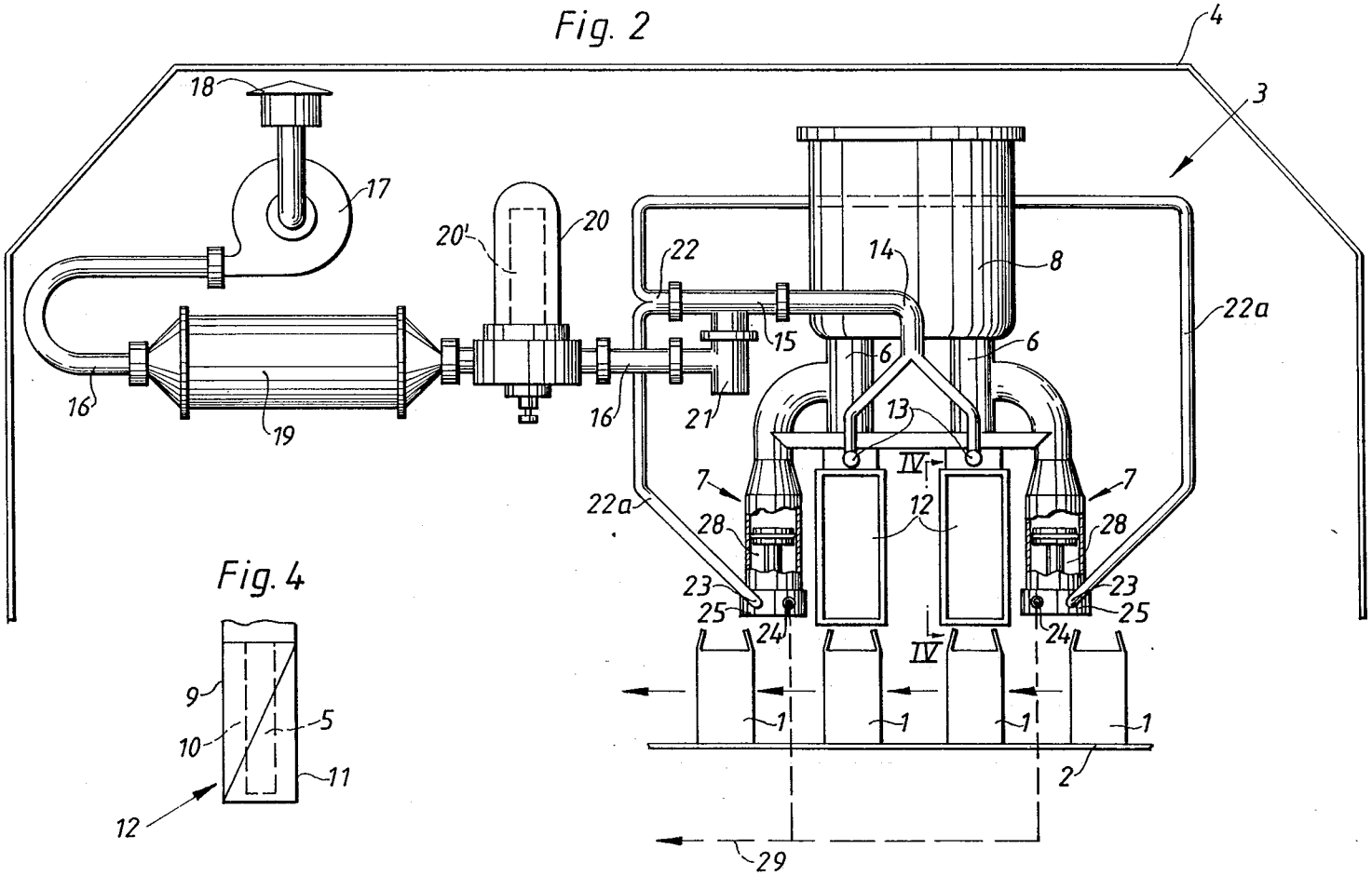
FIG. 2 illustrates the use of the arrangement in connection with a machine stoppage for the cleaning of the said product filling pipe.

The packing machine, of which thus only the actual filling station is shown in FIG. 1 and 2, may be, for example, a conventional packing machine of the type which is described above and which from precut, flattened, tubular blanks of a packing material of plastic-coated paper are produced finished, filled consumer packages for liquid foodstuffs, e.g. milk. The blanks first are raised to tubular, open container boxes of rectangular, usually square, cross-section with the help of a raising device (so-called box-raising means) arranged at the feed end of the machine. The raising device feeds out, one at a time, blanks from a magazine with simultaneous raising, and deposits the raised container boxes on a movable conveyor belt equipped with drivers. The conveyor belt transports the boxes to the first forming station where the boxes are threaded onto radial, correspondingly shaped mandrels on an indexing or intermittently rotating mandrel wheel. The mandrel wheel transports the boxes in steps through a number of forming and sealing stations located around the mandrel wheel whilst folding and sealing of one end or base of the boxes. The container boxes 1 provided with base are removed from the mandrels and are deposited on a movable conveyor belt 2 which in rhythm with the intermittent rotating movement of the mandrel wheel conveys the boxes in upstanding position to, and through, the filling station, shown schematically in FIG. 1 and 2. The filling station, which has been given the general reference designation 3, fills the boxes with the actual foodstuffs. After filling, the boxes are advanced further with the help of the conveyor belt 2 to the final forming station where the boxes, by means of suitable folding and sealing, are given a liquid-tight top closure. Thereafter the boxes leave the machine in the form of finished consumer packages.

The filling station 3 of the machine, which preferably is housed in a practically wholly enclosing machine casing 4 (shown schematically) comprises two vertical product filling pipes. Via feed pipes 6 with piston-type metering pumps 7 the filling pipes are in communication with a product tank 8 for the contents.

The product filling pipe 5 is partially surrounded by a tubular casing 9 arranged around each product filling pipe 5. The tubular casings are shaped such that a free flow space 10 is formed between the product filling pipes 5 and the respective casings 9. The lower end 9*a* of the casing 9 facing towards the opening of the product filling pipe 5 preferably is cut obliquely to expose the product filling pipe 5 from one direction of view (straight from the front in FIG. 1), is adapted so that it can be closed with the aid of a detachable, complementarily shaped lid element 11 (FIG. 2 and 4) to form of a circulation container 12 which substantially encloses the product filling pipe 5. The flow space 10 between the product filling pipe 5 and the surrounding casing 9 is adapted communicate with an outer flow system via connecting means 13 arranged at the upper part of the casing 9. Preferably, the connecting means 13 is located at a level above the top edge 9*b* of the obliquely cut casing ends.

The outer flow system comprises a branch pipe 14 joined to the connecting means 13 at one end and joined to an air supply duct 16 via a T-shaped junction at the other end. The air supply duct is connected to; a blower 17 with air intake 18, a heat exchanger 19 and a sterile filter device 20. Between the duct 16 and the junction 15 there is a valve 21 by means of which the connection between the duct 16 and the branch pipe 14 can be opened and closed as required. Also connected to the junction 15 is a further branch pipe 22, whose two branch pipe components 22*a* communicate with the respective inlets 23 of base plates 25 of the metering pumps. Each base plate 25 is provided with inlet 23 and outlet 24 of respective metering pumps 7 for the supply of sterile air to the cylinder chamber 28 of the pumps, as will be described.

When the arrangement in accordance with the present invention is to be used in order to provide a sterile filling atmosphere in the region directly adjoining the product filling pipe 5 during the filling process of the machine, the procedure is as follows with reference to FIG. 1. The valve 21 is opened so that free communication is established between the duct 16 and the two branch pipes 14 and 22 via the junction 15 located in between. When the blower 17 is started non-sterile, warm ambient air (approx. 35° C.) is sucked into the duct 16 via the air intake 18 and is impelled through the heat exchanger 19 (wherein the air is strongly cooled, approx. 7°–8° C. by means of giving off heat to cold, flowing heat exchange fluid, e.g. 2°–4° C.) and through the sterile filter device 20 wherein the cooled air is filtered during passage through a sterile filter. From the sterile filter device 20, the cold sterile air flows, via the valve 21, into the pipe junction 15 where the air stream is divided into two partial streams. One air stream flows via the branch pipe 14 joined to the connecting means 13 in and through the space 10 in intimate contact with the product filling pipe. The stream then leaves the casing 9 downwards through the obliquely cut open casing end 9*a* in the direction down towards the container boxes 1 on the movable conveyor belt 2 advanced centrally below the product filling pipe 5. As a result, a sterile atmosphere is also produced in the container boxes 1 above the level of contents rising during the filling. The other partial stream flows from the junction 15 through the branch pipe 22 and is conducted via the branch pipe components 22*a* into the cylinder chamber 28 of the respective pumps 7 through the inlet 23 in the base plates 25 and out via the outlet 24.

In this manner, an atmosphere of sterile, cooled air is procured around the product filling pipe of the packing machine as well as in the cylinder chambers 28 of the pumps 7 which come into contact with the contents during the filling process. Moreover, due to the tubular casing 9, the sterile air flowing through the casing will be directed downwards into the open container boxes during the filling, so that a sterile filling atmosphere is assured also in the region above the rising level of contents inside the boxes. The filling process can be monitored easily by inspection through the obliquely cut ends 9*a* of the casing which expose a substantial part of the product filling pipe 5 of the machine. Moreover the filling can be carried out, without any risk of condensate formation on the outsides of the filling pipe owing to the use of cold sterile air which, contrary to hot air, counteracts bacteria growth in foodstuffs deposited on particularly exposed parts of the machine.

When the arrangement is to be used for the cleaning of the product filling pipe of the machine and other machine parts that come into contact with the actual contents, the procedure is as follows with special reference to FIG. 2 and FIG. 4. The connection between the air supply duct 16 and the two said branch pipes 14 and 22, respectively, is interrupted through closing of the valve 21. Then, the open ends 9a of the casings 9 are closed with the aid of the detachable, complementarily shaped lid element 11, by means, the lid element 11 of a suitable fastening means is clamped tightly against the casing end 9a so that the product filling pipe 5 is enclosed in a flow container 12 formed by the parts 9 and 11 which is shown in FIG. 4. Cleansing liquid is supplied to the product tank 8 via a separate duct, not shown, and the pumps 7 are started for circulation of the cleansing liquid. The cleansing liquid is then pumped from the product tank 8, via the supply pipe 6, into and through the product filling pipe 5, while cleaning the insides of the pipe. The cleansing liquid that flows out through the opening of the product filling pipe will fill the space 10 in the cleaning containers 12 thus surrounding the product filling pipe 5 and cleaning the outsides of the pipes. The flow then travels upwards out through the containers through the branch pipe 14 joined to the connecting means 13 and into the T-shaped junction piece 15. From the junction piece 15, the cleansing liquid is pumped into the branch pipe 22 and further into the respective cylinder chamber 28 of the pumps 7 via the branch pipe components 22a connected to the inlet 23 in the base plates 25. After circulation in the spaces 28, the cleansing liquid is pumped out through the outlet 24 and through a duct separately connected to the outlet 24 during the cleaning process. The duct is depicted in FIG. 2 by broken lines at as 29 and serves to recirculate, for the flow to the product tank 8 via a central washing set-up or to a drain (not shown). When the cleaning of the machine parts is considered to be finished, they are rinsed with heated water which is pumped through the machine in the same manner as the cleansing liquid described for a complete rinsing out of the cleansing liquid and sterilization of the cleaned machine parts. Thereafter the machine is ready for a new filling process, the procedure being that described above with reference to FIG. 1 and 3.

To avoid any misunderstanding it should be noted terms that expressions such as "sterile", "sterilization" and similar which are used throughout the description naturally do not mean sterile, sterilization etc. in the absolute senses of the words. Instead the terms are intended to mean that degree of sterility which is sufficient for compliance with the demands made by the authorities in respect of hygiene in the normal handling of foodstuff.

We claim:

1. An arrangement on a packing machine comprising a product filling pipe having an opening at one end; a tubular casing element arranged around said product filling pipe so as to form a free flow space between the product filling pipe and the casing element, said casing element having a connecting means; an outer duct being in fluid communication to an outer duct for flowing fluid through said connecting means arranged on the casing element, said casing element having an end facing said opening of the product filling pipe, said end closable by a detachable lid element to form a container that substantially encloses the product filling pipe to allow circulation of a cleansing fluid, said outer duct being connected to an air supply duct by a T-shaped junction piece, said air supply duct being connected to a blower having an air intake, a heat exchanger and a sterile filter device, said air supply duct having a valve for selectively opening or closing a fluid communication between said air supply duct and said outer duct.

2. An arrangement in accordance with claim 1, including a metering pump with a cylinder chamber wherein said air supply duct is also adapted for selective communication with said cylinder chamber of said metering pump, said chamber being in communication with said product filling pipe by a pipe which, in turn, is connected to the junction piece.

3. An arrangement on a packing machine comprising:

a product filling pipe having an opening at one end;

a tubular casing surrounding said product filling pipe and spaced outwardly from said filling pipe to form a fluid passage between said product filling pipe and said casing, said casing having an end adjacent said opening of said product filling pipe;

lid means for selectively enclosing said product filling pipe in said casing during circulation of a cleansing fluid;

valve means for controlling a fluid flow to said casing;

conduit means for providing fluid communication between said casing and said valve means;

a source of air under pressure communicating with said valve means whereby air under pressure is supplied through said valve means to said fluid passage for sterilization around said filling pipe opening when said valve means is open; and a source of cleansing fluid communicating with said fluid passage when said valve means is closed.

4. An arrangement in accordance with claim 3, wherein said casing and said lid means have complementary, oblique end surfaces.

5. An arrangement in accordance with claim 4, wherein said conduit means is connected to said casing at an upper part of said casing at a level above a top edge of said oblique end surface of said casing.

6. An arrangement in accordance with claim 3, wherein said conduit means includes an outer duct connected to an air supply duct by a junction piece, said valve means disposed within said air supply duct, said junction piece having the shape of a T and said air supply duct being connected to a blower with an air intake, a heat exchanger and a sterile filter device.

7. An arrangement in accordance with claim 6, including a metering pump with a cylinder chamber wherein said air supply duct is also adapted for selective communication with said cylinder chamber of said metering pump, said chamber being in communication with said product filling pipe by a pipe which, in turn, is connected to the junction piece.

* * * * *